United States Patent [19]

Willis

[11] 4,212,242

[45] Jul. 15, 1980

[54] CAN CRUSHING DEVICE

[76] Inventor: Kenneth L. Willis, 407 Sierra Dr., Euless, Tex. 76039

[21] Appl. No.: 34,638

[22] Filed: Apr. 30, 1979

[51] Int. Cl.[2] ..... B30B 7/00

[52] U.S. Cl. ..... 100/233; 100/DIG. 2; 100/293; 100/295

[58] Field of Search ..... 100/DIG. 2, 293, 295, 100/233, 264, 236; 241/99; D15/123

[56] References Cited

U.S. PATENT DOCUMENTS

| | | | |
|---|---|---|---|
| 809,512 | 1/1906 | Von Derlinde | 100/DIG. 2 |
| 2,603,270 | 7/1952 | Voigt | 100/233 |
| 3,766,849 | 10/1973 | Maron | 100/233 |
| 3,980,015 | 9/1976 | Woodard | 100/233 |

*Primary Examiner*—Billy J. Wilhite

*Attorney, Agent, or Firm*—Hubbard, Thurman, Turner, Tucker & Glaser

[57] ABSTRACT

Manually operated apparatus adapted for crushing cans including means for attaching the apparatus to a garbage container. The apparatus includes a pair of elongated structural elements rigidly spaced apart in parallel relationship. A fixed crushing plate is carried between the structural elements and a pair of movable crushing plates are rotatably carried on the structural elements and positioned to rotate into contact with the fixed crushing plate. A pair of arms attached to the moveable crushing plate have ends extending out beyond the structural elements. An operating lever is carried by the structural elements and has a first end over said crushing plates and coupled to the arms on the moveable crushing plates. The apparatus is operated by application of manual force to the second end of the lever.

9 Claims, 3 Drawing Figures

CAN CRUSHING DEVICE

BACKGROUND OF THE INVENTION

This invention relates to apparatus for crushing cans and more particularily to manually operated apparatus for crushing cans which is adapted for support on a garbage container.

Due to rising energy costs and material shortages, the recycling of materials has become increasingly important. The recycling of aluminum cans, particularly beverage containers, has become standard practice with permanent facilities provided for receiving and processing the returned cans. For a trip to a recycling plant to be economically attractive to an individual, he should have a fairly large quantity, for example 100 pounds, of cans to be recycled. For such a large quantity of cans to be transported in a reasonable volume, such as the trunk of a car, the cans must be crushed or flattened to reduce the volume as much as possible. Once the cans have been flattened and the effective density thereby increased, a fairly sturdy container for carrying the cans such as a common steel garbage can is required.

While numerous methods have been used for flattening cans such as beating with a hammer, stepping on the cans, or running over them with a car, it can be seen that a simple manual can crusher would be desireable. In addition, it would be desireable to provide a manual can crusher adapted for use in conjunction with a storage container, such as a common garbage can for storing the crushed cans prior to recycling.

SUMMARY OF THE INVENTION

Accordingly an object of the present invention is to provide a simple manual can crusher.

Another object of the present invention is to provide a can crusher adapted for mounting on and use in conjunction with a refuse receptacle.

These and other objects are achieved by providing can crushing apparatus comprising a planar supporting structure, a fixed crushing plate carried on the supporting structure, a pair of moveable crushing plates hingedly supported on the supporting structure so as to be rotatable to a position overlapping and substantially covering the fixed crushing plate, and an operating lever pivotally connected to the structural elements and linked to the rotatable plates so the plates may be manually forced together crushing a can therebetween and against the fixed crushing plate.

BRIEF DESCRIPTION OF THE DRAWINGS

The present invention may be better understood by reading the following detailed description of the preferred embodiment with reference to the accompanying drawing wherein.

DESCRIPTION OF THE PREFERRED EMBODIMENT

Figure 1:
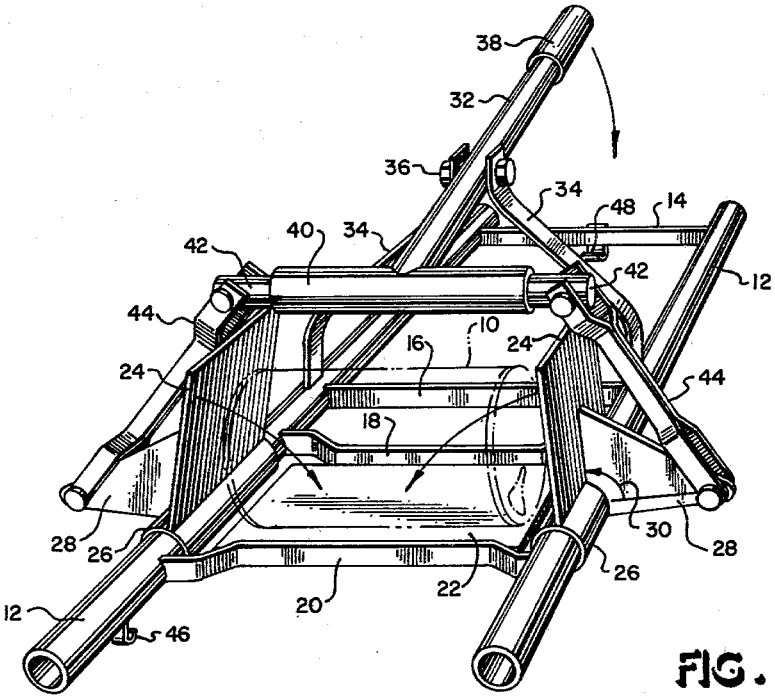
FIG. 1 is a generally end-on perspective view of can crushing apparatus according to the present invention in its open position with a can shown in phantom.

With reference now to FIG. 1, there is shown a generally end-on perspective view of can crushing apparatus according to the present invention in its open position ready to receive a can 10 shown in phantom. The apparatus is constructed generally around a pair of elongated structural elements 12 which are preferably steel tubes or pipes. The tubes 12 are parallel to each other and spaced apart by a distance somewhat greater than the length of can 10. In the preferred form four spacing struts, 14, 16, 18 and 20 are welded between the tubes 12 and together provide a very rigid supporting structure. A flat steel plate 22 positioned between tubes 12 and welded to the struts 18 and 20 acts as a fixed crushing plate. A pair of moving crushing plates 24 are hingedly or rotatably carried on the pipes 12 between the struts 18 and 20. In the preferred form, plates 24 are welded to short sections of pipe 26 which are carried on the elements 12. Each of the moving crushing plates 24 carries a generally triangular shaped arm 28 welded to the plate 24 and the pipe section 26. An angle indicated at 30 formed between arms 28 and plates 24 is somewhat greater than 90 degrees. This angle insures that when the plates 24 are rotated into a closed position over plate 22, the ends of arms 28 are still outboard of pipes 12 so that a sufficient moment arm is available for applying torque to the plates 24 as will be explained more fully below.

The tubes 12 and cross struts 14, 16, 18 and 20 provide a preferred form of rigid planar supporting structure. It is apparent that other types of base, such as a flat steel plate or a wooden plank, could be used to support the apparatus of the present invention. The illustrated arrangement is preferred because it provides great strength with minimum weight and provides a convenient hinging support for moving plates 24.

An operating lever 32 is pivotably supported on a pair of supports 34 welded to the structural elements 12. In a preferred form, a pivot 36 is merely a bolt passing through the support brackets 34 and the lever 32. A hand grip 38 in the form of a bicycle handle bar grip is provided on one end of lever 32. On the opposite end of lever 32, is a cross member 40. A short section of pipe 42 is rotatably carried within cross member 40 and extends from each end thereof. A pair of linkage elements 44 are pivotably connected between the ends of pipe 42 and the ends of arms 28.

Figure 2:
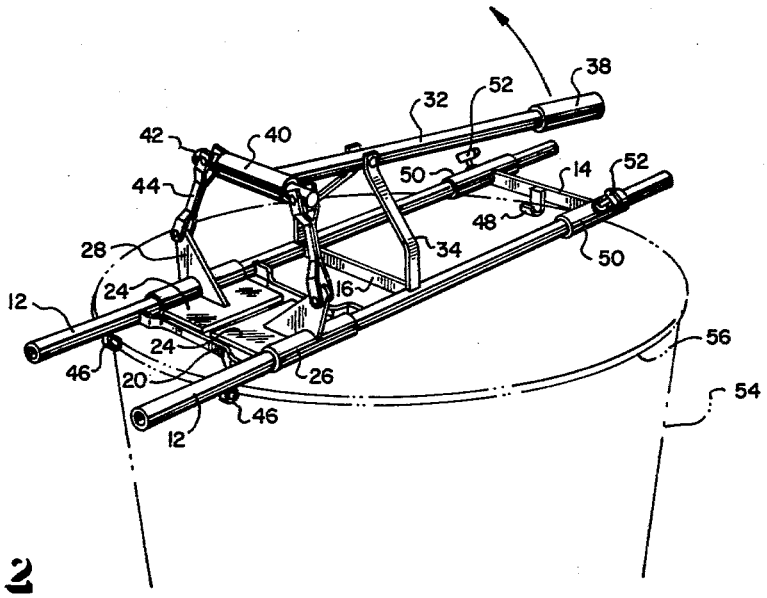
FIG. 2 is a generally side perspective view of the can crushing apparatus of the present invention showing the crushing plates in closed position and illustrating means for clamping the apparatus to a refuse container shown in phantom.

With reference now to FIG. 2 further details are shown in a side view of a slightly modified form of the apparatus in its closed position. Elements which appear in both FIGS. 1 and 2 carry the same designation numbers. In FIG. 2, the grip 38 is in its lower-most position so that cross member 40 is in its upper-most position and moving crushing plates 24 are rotated into a closed position where they overlie and substantially cover the fixed crushing plate 22.

A pair of J-shaped hooks 46 are illustrated attached to the lower surface of structural elements 12 at the ends near the crushing plates. A similar hook 48 is illustrated attached to the cross strut 14 at the other end of the structural elements 12. In this FIG. 2 embodiment the strut 14 is welded to a pair of slidable sleeves 50 carried on elements 12. Each sleeve 50 carries a thumb screw and bolt arrangement 52 for locking the sleeves 50 into place on elements 12. This arrangement allows the distance between hooks 46 and hook 48 to be adjusted.

Another element illustrated in FIG. 2 is a garbage container 54 shown in phantom. The container 54 has an outwardly extending lip or rim 56 around its top edge under which the J-hooks 46 and 48 are snapped. By this arrangement, the crushing apparatus is positioned at a convenient working height, and after cans are crushed they may be conveniently dropped into the can 54 for storage. It is apparent that other means may be provided for clamping the crushing apparatus to a refuse container depending generally on what type of container is being used. The arrangements illustrated are preferred simply because they are adapted for use with commonly available steel garbage cans.

In use the can crushing apparatus of the present invention is preferably attached to the top of the garbage can as illustrated in FIG. 2. The user then grips the apparatus by hand grip 38 and raises it to its highest position at which point the moving crushing plates 24 are raised to the open position illustrated in FIG. 1. An empty can, preferably an aluminum beverage container, is then placed upon the fixed crushing plate 22 as illustrated in phantom in FIG. 1. The user then forces the grip 38 downward and the force is transmitted through the cross member 40, linkages 44 and arms 28 to the moving crushing plates 24. The plates 24 then crush the can by folding the top and bottom of the can towards each other and down onto the fixed crushing plate 22. When the container is filled with crushed cans, the crushing apparatus may be simply removed from the top and the can 54 used to transport the cans to a recycling center.

Figure 3:
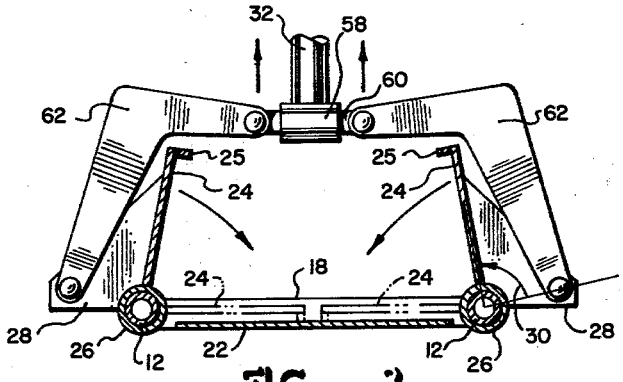
FIG. 3 is an elevational view of an alternate linkage arrangement.

As noted above, the angle 30 in FIG. 1 is somewhat greater than 90 degrees to provide a moment arm for converting the upward force of cross member 40 to torque in plates 24 when the plates are in the closed position. An alternate form of cross bar and linkage are shown in elevation in FIG. 3. The following elements shown in FIG. 1 also appear, at least partially in FIG. 3: lever 32, elements 12, strut 18, fixed crushing plate 22, moving crushing plates 24, and arms 28. A shortened cross bar 58 and rotatable pipe 60 are carried on the end of lever 32. A pair of L-shaped links 62 are pivotally connected between the ends of pipe 60 and the outboard ends of arms 28. By use of the L-shaped links 62 the direction of the forces applied to arms 28 at the beginning of the crushing stroke pass through the plates 24. At the end of the stroke the force direction is still at a fairly steep angle and thereby provides a larger effective moment arm than the arrangement of FIG. 1. It is apparent that a number of other linkage arrangements would be useful in this apparatus. It is also apparent that with this cross bar 58 and linkage 62 arrangement the angle 39 may be 90° as shown in FIG. 3 or even somewhat less. Preferably angle 30 is still somewhat larger than 90° to further increase the moment arm in the closed position.

Another feature illustrated most clearly in FIG. 3 is the position of fixed plate 22. Plate 22 is preferably attached near the lower edges of struts 18 and 20 rather than being positioned directly between the centers of elements 12. As a result when plates 24 are rotated to the closed position a uniform space of about one eighth to one quarter inch is provided between plate 22 and plates 34. This uniform spacing allows the apparatus to uniformly crush a can along its full length and avoids excessive crushing near the ends.

Yet another alternative feature illustrated in FIG. 3 is a pair of flanges 25 extending at right angles from the upper edges of moving crushing plates 24. In the open position illustrated, these flanges 25 overlap the ends of a can to prevent it from slipping off fixed plate 22 as force is first applied. At the end of the crushing stroke these flanges help apply greater force to the center of the crushed can, which is usually the point of greatest resistance.

While the present invention has been shown and illustrated in terms of specific apparatus, it is apparent that various modifications and changes may be made within the scope of the present invention as defined by the appended claims.

I claim:

1. Apparatus for crushing cans comprising:
a planar supporting structure,
a fixed crushing plate carried on said supporting structure,
a pair of moving crushing plates rotatably carried on said supporting structure in alignment with said fixed crushing plate, whereby in a closed position first surfaces of said moving crushing plates overlie and substantially cover said fixed crushing plate,
a pair of arms each having a first end connected to a second surface of said moving crushing plates,
a lever pivotally carried by said supporting structure having a first end positioned above said fixed crushing plate and coupled to second ends of said arms, and a second end forming a grip for manual operation of said apparatus,
whereby upon lifting said grip said moving crushing plates move to an open position in which a can may be placed on said fixed crushing plate and upon forcing said grip downward said moving crushing plates move to a closed position crushing said can.

2. Apparatus according to claim 1 further including clamping means carried on said apparatus for clamping said apparatus to the top rim of a refuse receptacle.

3. Apparatus according to claim 2 wherein said clamping means comprise a plurality of J-shaped hooks carried on the lower surface of said supporting structure adapted for receiving an outwardly extending rim of a metal refuse receptacle.

4. Can crushing apparatus according to claim 1 wherein,
said planar supporting structure comprises a pair of elongated structural elements and a plurality of cross struts rigidly spacing said structural elements spaced apart in parallel relationship,
and said fixed crushing plate is carried between said structural elements and rigidly connected to a pair of said cross struts.

5. Can crushing apparatus according to claim 4 wherein
said elongated structural elements are steel tubes, and
said moving crushing plates are carried on said structural elements by means of a pair of hollow tube sections each connected to one edge of one of said moving crushing plates.

6. Can crushing apparatus according to claim 4 further including clamping means carried on said apparatus for clamping said apparatus to the top rim of a refuse receptacle.

7. Apparatus according to claim 6 wherein said clamping means comprises a plurality of J-shaped hooks carried on lower surfaces of said structural elements and one of said cross struts adapted for receiving an outwardly extending rim of a metal refuse receptacle.

8. Apparatus according to claim 6 further including a pair of slideable sleeves carried on first ends of said structural elements and a cross strut carried between said sleeves, wherein said clamping means includes a pair of J-shaped hooks carried on lower surfaces of second ends of said structural elements and a J-shaped hook carried on said cross strut.

9. Can crushing apparatus according to claim 4 wherein the second ends of said arms are positioned outboard of said structural elements when said moving crushing plates are in said closed position.

* * * * *